US012364329B2

(12) United States Patent
Coppolino et al.

(10) Patent No.: US 12,364,329 B2
(45) Date of Patent: Jul. 22, 2025

(54) HANGING ORGANIZER

(71) Applicants: Michael Coppolino, Hudson, MA (US); David Harris, Nashua, NH (US)

(72) Inventors: Michael Coppolino, Hudson, MA (US); David Harris, Nashua, NH (US)

(73) Assignee: COPPS ENTERPRISE INC., Hudson, MA (US)

( * ) Notice: Subject to any disclaimer, the term of this patent is extended or adjusted under 35 U.S.C. 154(b) by 0 days.

(21) Appl. No.: 18/388,824

(22) Filed: Nov. 11, 2023

(65) Prior Publication Data

US 2024/0156256 A1 May 16, 2024

Related U.S. Application Data

(60) Provisional application No. 63/424,683, filed on Nov. 11, 2022.

(51) Int. Cl.
*A47B 81/00* (2006.01)

(52) U.S. Cl.
CPC ..... *A47B 81/00* (2013.01)

(58) Field of Classification Search
CPC ..... A47B 81/00; A47K 10/04; B25H 3/04; A47G 29/08; A47F 5/0807
See application file for complete search history.

(56) References Cited

U.S. PATENT DOCUMENTS 887,272 A * 5/1908 Robinson ..... F16L 3/2235 29/897.3
2,288,706 A * 7/1942 Herr ..... A47G 1/1633 47/41.01
3,255,987 A * 6/1966 Gatch ..... F16B 21/02 248/314
3,300,173 A * 1/1967 Kennedy, Jr. ..... A47G 1/22 248/467
3,443,783 A * 5/1969 Fisher ..... F16B 21/02 411/908
3,800,369 A * 4/1974 Nikolits ..... F16B 5/10 24/297
4,527,760 A * 7/1985 Salacuse ..... F16B 21/02 248/108
4,637,583 A * 1/1987 Babitz ..... A47G 1/205 248/497

(Continued)

*Primary Examiner* — Ko H Chan
(74) *Attorney, Agent, or Firm* — White-Welker & Welker, LLC; Matthew T. Welker, Esq.

(57) ABSTRACT

An organizer and hanger having a generally rectangular body with a plurality of protrusions/clips/hooks extending from a front surface for securing or handing objects. The body can also have double sided tape applied to tabs on each opposing end or a hole on one or both of the opposing end tabs for engaging a screw or nail. The protrusions/clips/hooks extend from a front side of the body, where the protrusions/clips/hooks are generally an "s" shape when viewed from the side, where the protrusions/clips/hooks are attached on one end to the body. A small rubber sleeve/pad can be attached to the protrusion/clip/hook portion between the first and second bends along the "s" shape. The rubber sleeve/pad increases the coefficient of friction compared to a metal or plastic without a rubber sleeve/pad. This rubber sleeve/pad is critical to providing a better holding force for some objects and noise reduction.

4 Claims, 23 Drawing Sheets

(56) References Cited

U.S. PATENT DOCUMENTS 4,640,478 A * 2/1987 Leigh-Monstevens ..... F16D 25/12 248/27.1
4,756,498 A * 7/1988 Frye ..... F16B 47/003 248/467
5,038,985 A * 8/1991 Chapin ..... G01B 5/0002 24/3.12
6,095,465 A * 8/2000 Weck ..... A47G 1/20 248/467
D466,796 S * 12/2002 Lacey ..... D8/372
6,695,269 B1 * 2/2004 Anscher ..... A45C 13/30 248/225.11
7,219,459 B2 * 5/2007 Valiulis ..... G09F 3/14 211/113
7,764,857 B2 * 7/2010 Sjodin ..... G02B 6/44526 174/545
8,522,986 B2 * 9/2013 Kitchen ..... B25H 3/04 248/220.31
8,967,398 B2 * 3/2015 McLemore ..... F16M 13/02 211/113
9,174,826 B1 * 11/2015 Nieves ..... E04B 2/7407
D800,477 S * 10/2017 Wall ..... D6/553
10,986,941 B2 * 4/2021 Zalme ..... F16B 21/04
11,560,979 B2 * 1/2023 Zalme ..... F16M 13/022
11,788,571 B2 * 10/2023 Huber ..... F16B 5/02 29/464
D1,020,423 S * 4/2024 Crook ..... D12/406
2003/0221700 A1 * 12/2003 La Fauci ..... A45D 8/14 132/276
2007/0278163 A1 * 12/2007 Barkdoll ..... A47F 5/0807 211/59.1
2012/0037772 A1 * 2/2012 Inglehart ..... A47G 25/74 248/224.8
2022/0042539 A1 * 2/2022 Huber ..... F16B 21/02
2023/0329195 A1 * 10/2023 Fowler ..... F16M 13/022

* cited by examiner

HANGING ORGANIZER

FEDERALLY SPONSORED RESEARCH

Not Applicable

SEQUENCE LISTING OR PROGRAM

Not Applicable

TECHNICAL FIELD OF THE INVENTION

The present invention relates in general to hanging organizers. More specifically, the present invention relates to hanging organizers for hanging lightweight objects on walls or cabinet doors without damaging the surface.

BACKGROUND OF THE INVENTION

Cabinets and walls in kitchens, pantries, and other areas are commonly used for the storage of food and various household products such as dish towels, bags, soaps, paper towels, food wrap, and cleaning supplies. Other household areas such as bathrooms, basements, laundry rooms and garages are also often provided with cabinets and walls. Because of the variety of items that are typically stored in cabinets or hung on walls or shelving, it is common for the cabinets and/or walls and shelving units to become cluttered and disorganized.

The hinged doors that open and close base cabinets are used at times to hold racks which are permanently fixed to the inside door surface. However, the use of space is not efficient in this type of arrangement. Further, the need to mount a storage rack permanently with fasteners such as screws results in permanent marking of the door surface.

Therefore, what is needed is a hanging organizer that can be mounting to hold heavy or lightweight items in a non-permanent or marring fashion.

SUMMARY OF THE INVENTION

The present invention is an organizer and hanger. The device is comprised of a generally rectangular body with a plurality of protrusions/clips/hooks extending from a front surface for securing or hanging objects. The generally rectangular body can also have double sided tape applied to tabs on each opposing end or a hole on one or both of the opposing end tabs for engaging a screw or nail.

The generally rectangular body is further comprised of three protrusions/clips/hooks/hooks, which are also generally rectangular, having rounded external edges and an oval or elongated center hole. In a preferred embodiment, the organizer and hanger has three protrusions/clips/hooks/hooks, which extend from three symmetrical locations on the generally rectangular body. The protrusions/clips/hooks/hooks extend from a front side of the generally rectangular body.

The protrusions/clips/hooks/hooks extend from a front side of the generally rectangular body, where the protrusions/clips/hooks/hooks are generally an "s" shape when viewed from the side, where the protrusions/clips/hooks/hooks are attached on one end to the generally rectangular body, where the connected portion extends forward away from the front side of the generally rectangular body, until a bend which brings the protrusion/clip/hook back toward the front side of the generally rectangular body for a given distance, until a second bend which then brings the protrusion/clip/hook away from the front side of the generally rectangular body for a given distance, that is generally shorter than the distance between the first and second bends.

In an alternative embodiment of the present invention a small rubber sleeve or sleeve/pad can be attached to the protrusion/clip/hook portion between the first and second bends. The rubber sleeve/pad increases the coefficient of friction compared to a metal or plastic embodiment of the present invention without a rubber sleeve/pad. This rubber sleeve/pad is critical to providing a better holding force for some objects as well as reducing rattle or noise when used on cabinet doors or other movable surfaces. In the latter situation, the rubber sleeve/pad reduces vibration noise during movement or vibrations experienced by the wall or cabinet door where the present invention might be mounted.

The sleeve/pad may be attached or retained to the protrusion/clip/hook using the oval or elongated holes on the protrusion/clip/hook or it may simply be formed to create a compression fit around the protrusion/clip/hook surface and opposing sides to hold it into place.

BRIEF DESCRIPTION OF THE DRAWINGS

The accompanying drawings, which are incorporated herein and form a part of the specification, illustrate the present invention and, together with the description, further explain the principles of the invention and to enable a person skilled in the pertinent art to make and use the invention.

DETAILED DESCRIPTION OF THE INVENTION

In the following detailed description of the invention of exemplary embodiments of the invention, reference is made to the accompanying drawings (where like numbers represent like elements), which form a part hereof, and in which is shown by way of illustration specific exemplary embodiments in which the invention may be practiced. These embodiments are described in sufficient detail to enable those skilled in the art to practice the invention, but other embodiments may be utilized, and logical, mechanical, electrical, and other changes may be made without departing from the scope of the present invention. The following detailed description is, therefore, not to be taken in a limiting sense, and the scope of the present invention is defined only by the appended claims.

In the following description, specific details are set forth to provide a thorough understanding of the invention. However, it is understood that the invention may be practiced without these specific details. In other instances, well-known structures and techniques known to one of ordinary skill in the art have not been shown in detail in order not to obscure the invention. Referring to the figure, it is possible to see the various major elements constituting the apparatus of the present invention.

The present invention is an organizer and hanger 10. The device is comprised of a generally rectangular body 11 with a plurality of protrusions/clips/hooks 12 extending from a front surface 13 for securing or hanging objects. The generally rectangular body 11 can also have one or more holes 13-14 on one or both ends 26-27 for engaging a screw or nail.

Figure 1:
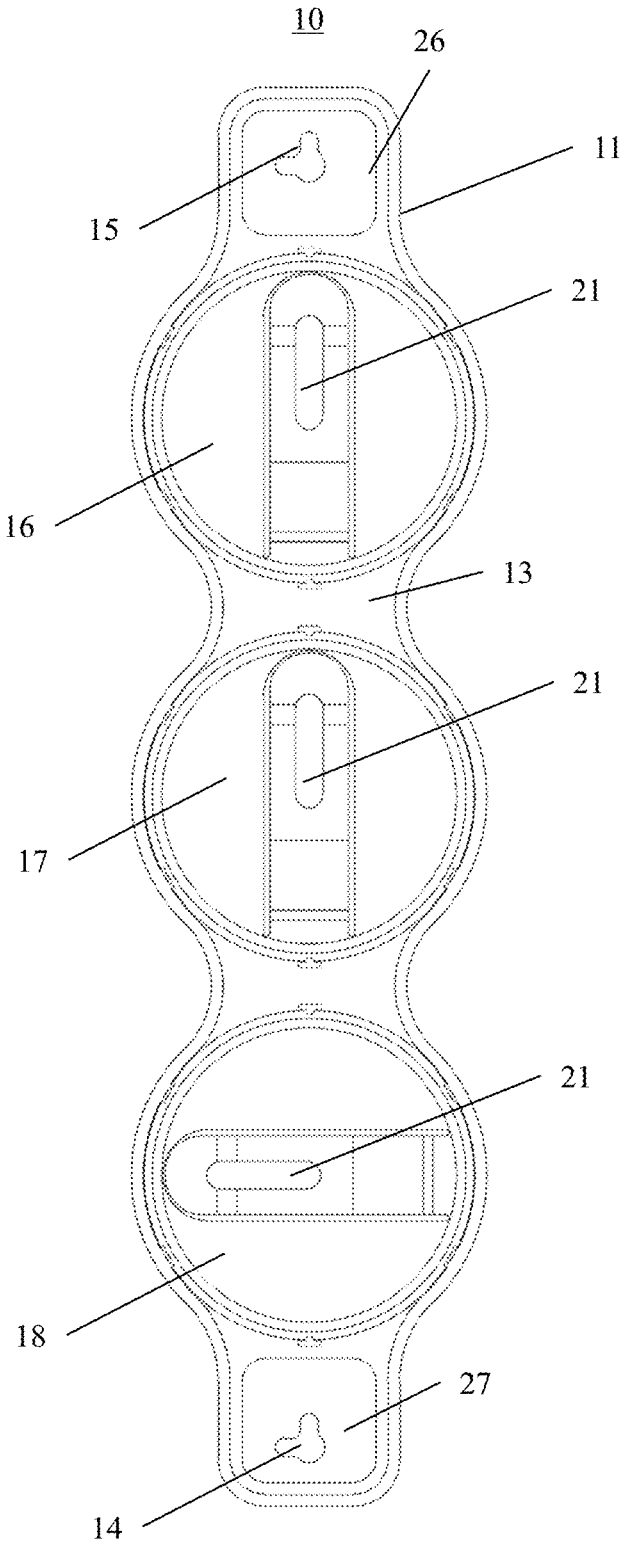
FIG. 1 is a front planar view of the organizer and hanger taught by the present invention.
Figure 3:
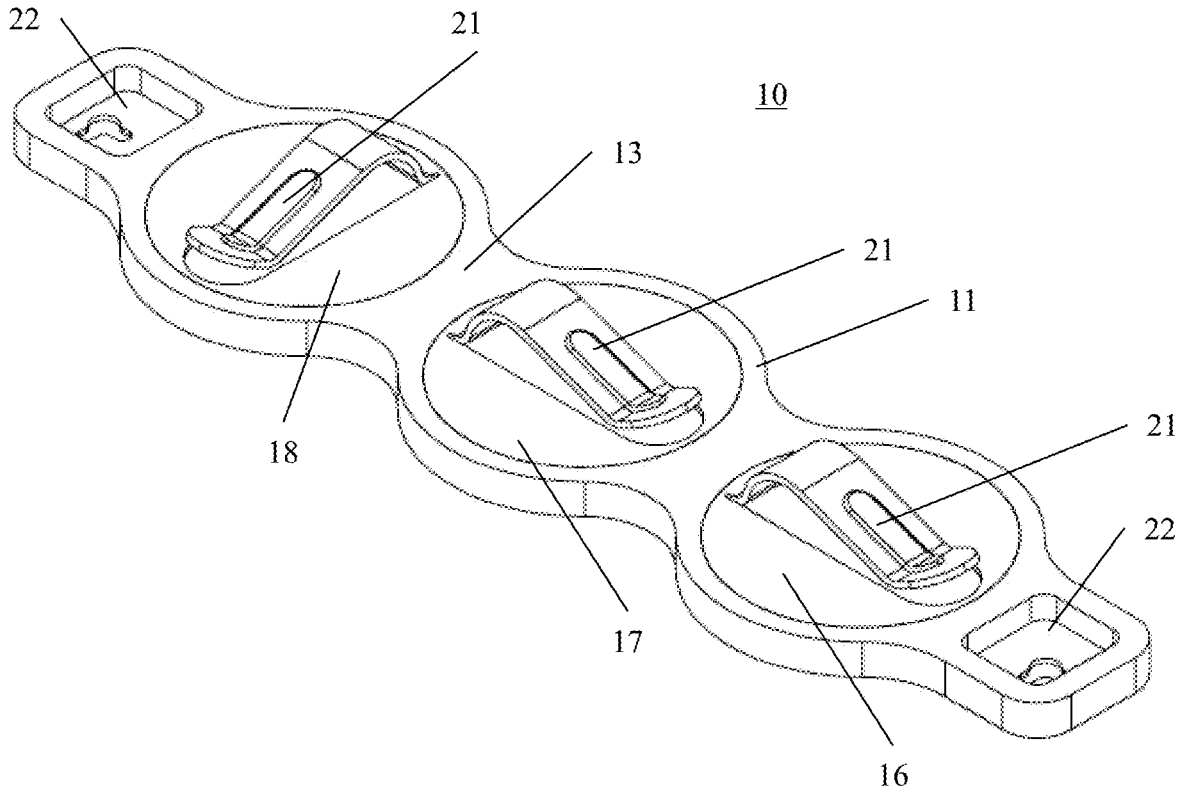
FIG. 3 is a front perspective view of the organizer and hanger taught by the present invention.
Figure 6:
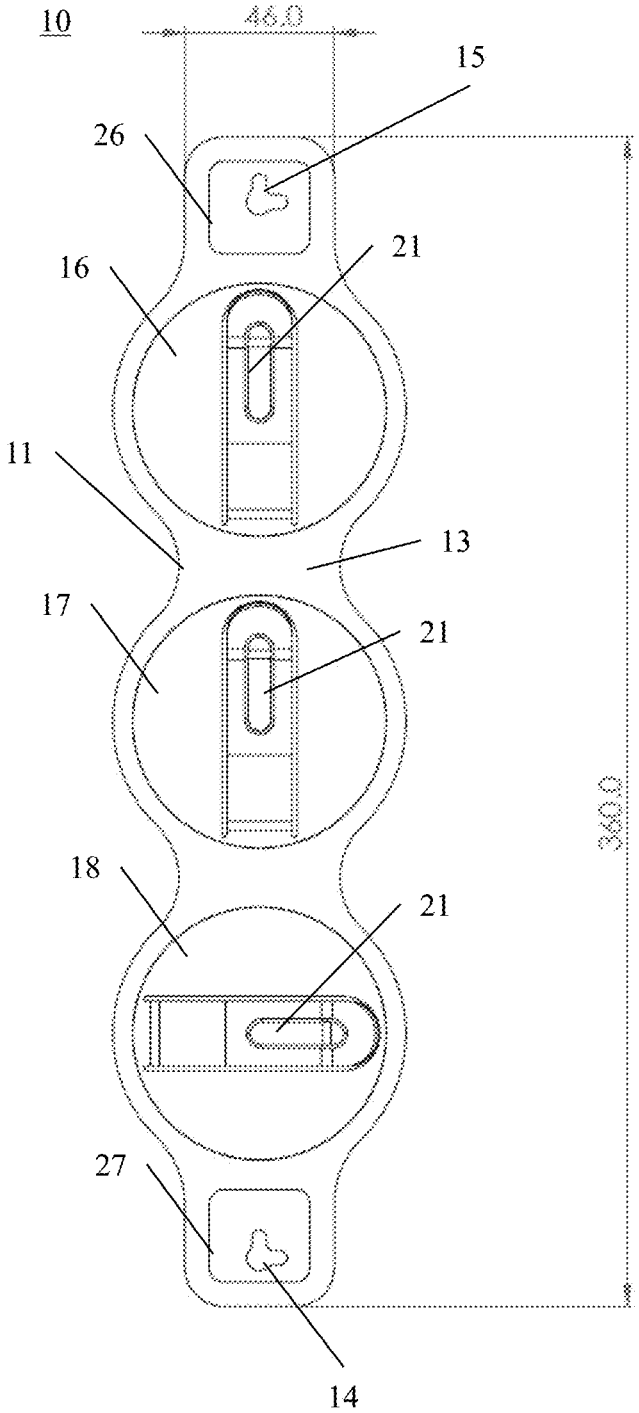
FIG. 6 is a front planar view of the organizer and hanger taught by the present invention denoting exemplary measurements in millimeters.

FIG. 1 is a front planar view of the organizer and hanger 10 taught by the present invention, FIG. 3 is a front perspective view of the organizer and hanger 10 taught by the present invention, and FIG. 6 is a front planar view of the organizer and hanger 10 taught by the present invention denoting exemplary measurements in millimeters.

As shown in FIGS. 1, 3, and 6, the generally rectangular body 11 is further comprised of three protrusions/clips/hooks 16, 17, 18, which are also generally rectangular 19, having rounded external edges 20 and an oval or elongated center hole 21. The generally rectangular body 11 can also have double sided tape 23-24 applied to tabs 26-27 on each opposing end or one or more holes 14-15 on one or both of the opposing end tabs 26-27 for engaging a screw or nail. In this exemplary figure, the top two protrusions/clips/hooks 16-17 are oriented in an upward direction, where the bottom or third protrusion/clip/hook 18 is oriented to a ninety degree left direction.

Figure 2:
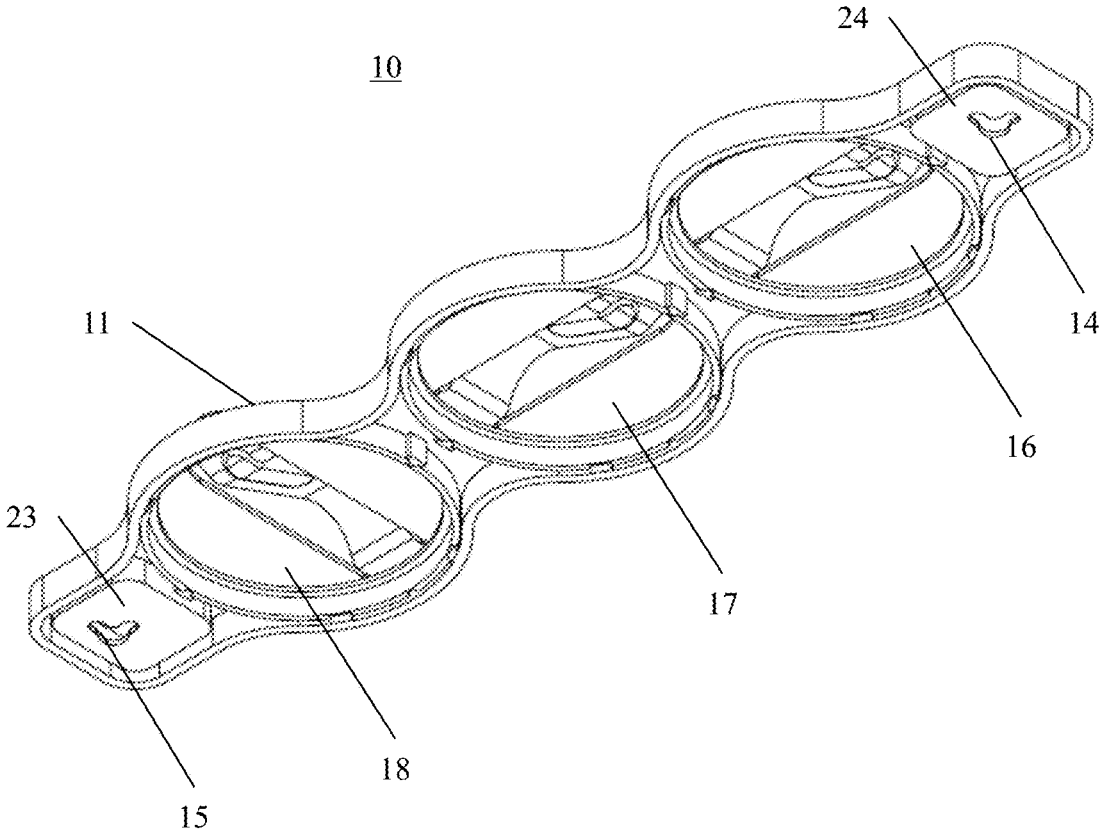
FIG. 2 is a bottom perspective view of the organizer and hanger taught by the present invention.

FIG. 2 is a bottom perspective view of the organizer and hanger 10 taught by the present invention. As shown in FIG. 2, the generally rectangular body 11 is further comprised of three protrusions/clips/hooks 16-18, which are also generally rectangular 19, having rounded external edges 20 and an oval or elongated center hole 21. The generally rectangular body 11 can also have double sided tape 23-24 applied to tabs 26-27 on each opposing end or one or more holes 14-15 on one or both of the opposing end tabs 26-27 for engaging a screw or nail. In this exemplary figure, the top two protrusions/clips/hooks 16-17 are oriented in an upward direction, where the bottom or third protrusion/clip/hook 18 is oriented to a ninety degree left direction.

In FIGS. 1-3, and 6, the protrusions/clips/hooks 16-18 are shown extending from a front surface or side 13 of the generally rectangular body 11.

Figure 4:
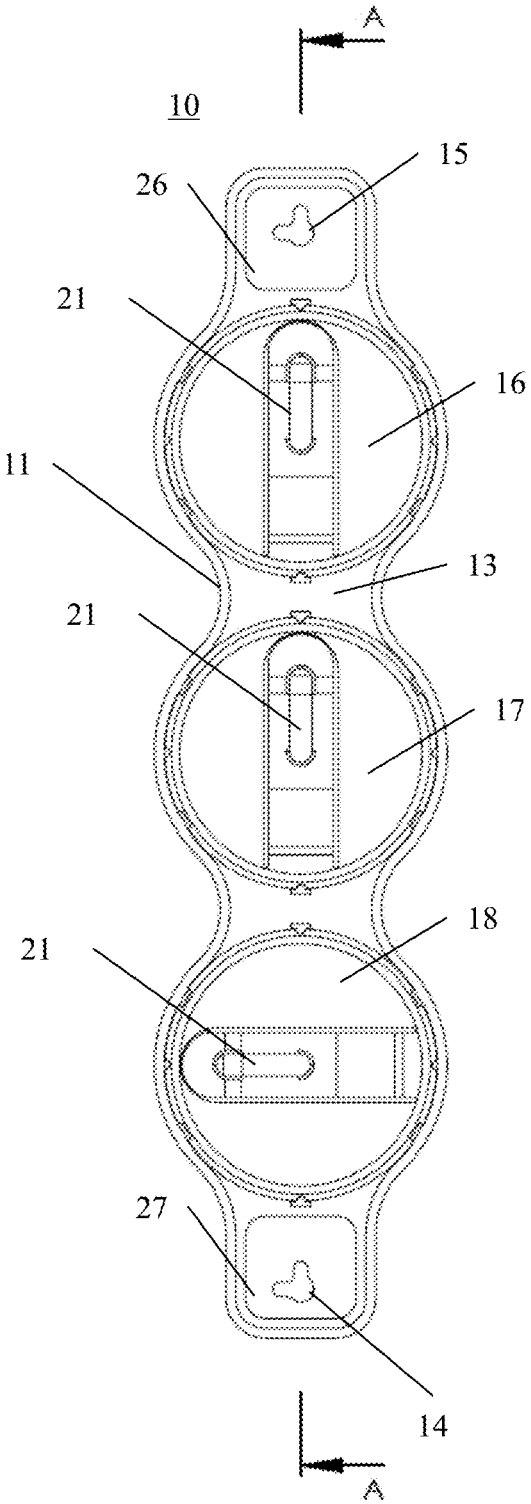
FIG. 4 is a front planar view of the organizer and hanger taught by the present invention denoting a section "A", corresponding to the detailed description discussion.
Figure 5:
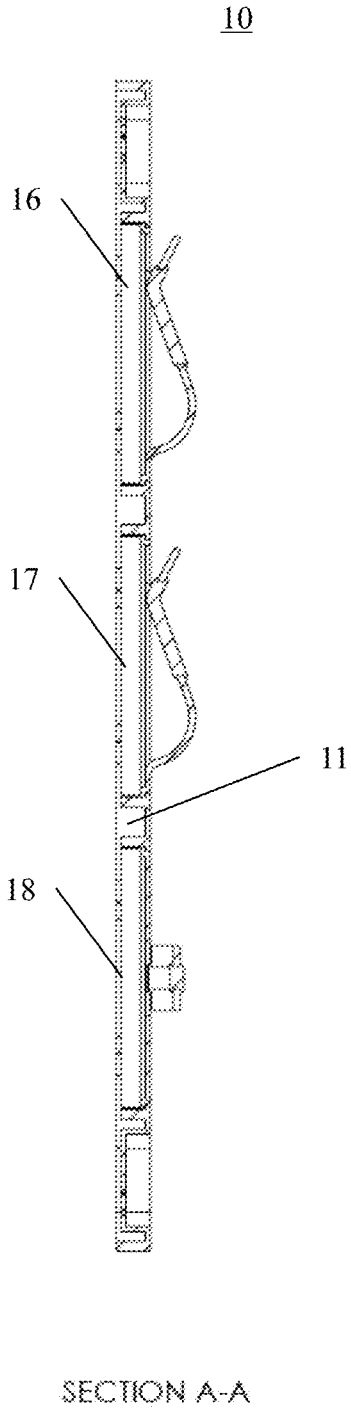
FIG. 5 is a side planar view of the organizer and hanger taught by the present invention denoting a section A, corresponding to the detailed description discussion.
Figure 11:
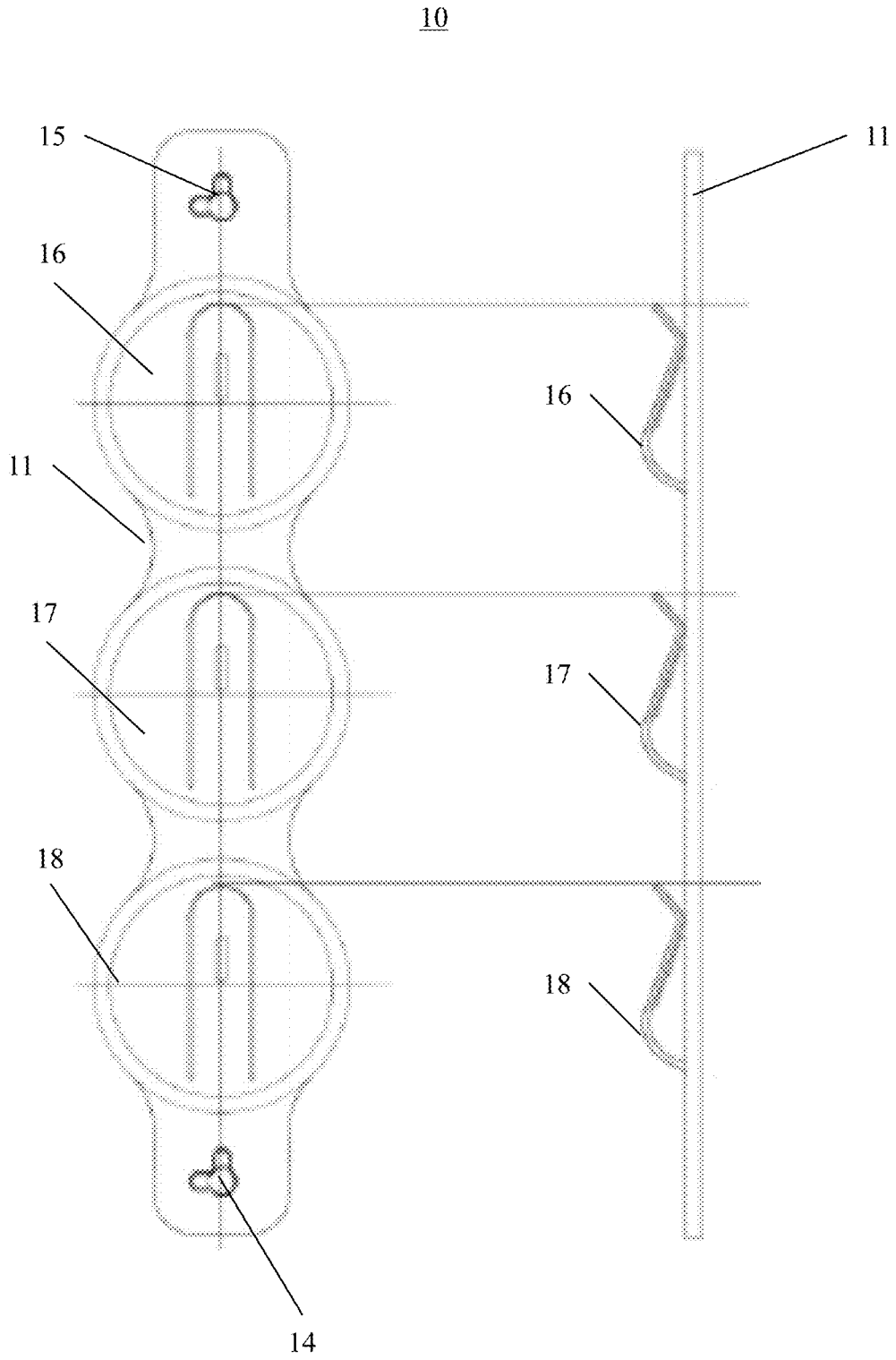
FIG. 11 is a front planar view and a side planar view of the organizer and hanger taught by the present invention with references lines illustrating the reference points of features between both views for better understanding and clarity.

FIG. 4 is a front planar view of the organizer and hanger 10 taught by the present invention denoting a section "A", corresponding to the detailed description discussion. FIG. 5 is a side planar view of the organizer and hanger 10 taught by the present invention denoting a section A, corresponding to the detailed description discussion. FIG. 11 is a front planar view and a side planar view of the organizer and hanger 10 taught by the present invention with references lines 25 illustrating the reference points of features between both views for better understanding and clarity.

As in FIGS. 1-3, and 6, again the generally rectangular body 11 is further comprised of three protrusions/clips/hooks 16-18, which are also generally rectangular 19, having rounded external edges 20 and an oval or elongated center hole 21. The generally rectangular body 11 can also have double sided tape 23-24 applied to tabs 26-27 on each opposing end or one or more holes 14-15 on one or both of the opposing end tabs 26-27 for engaging a screw or nail. In this exemplary figure, the top two protrusions/clips/hooks 16-17 are oriented in an upward direction, where the bottom or third protrusion/clip/hook 18 is oriented to a ninety degree left direction.

This section A and section A-A comparison views of FIGS. 4 and 5 is provided to show the organizer and hanger 10 of the present invention is a matching orientation to better assist in explaining and understanding of the present invention.

Figure 7:
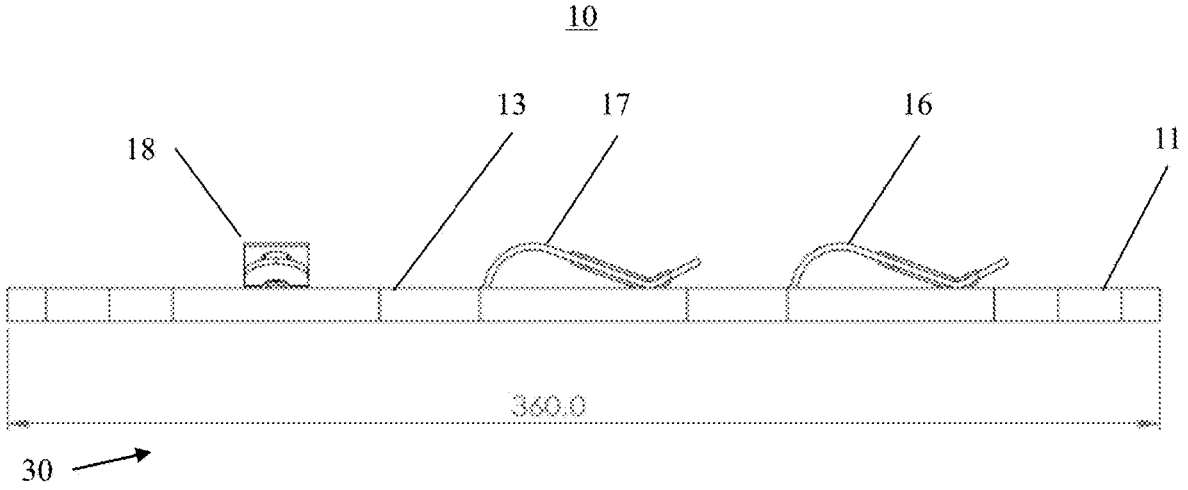
FIG. 7 a side planar view of the organizer and hanger taught by the present invention denoting exemplary measurements in millimeters.
Figure 8:
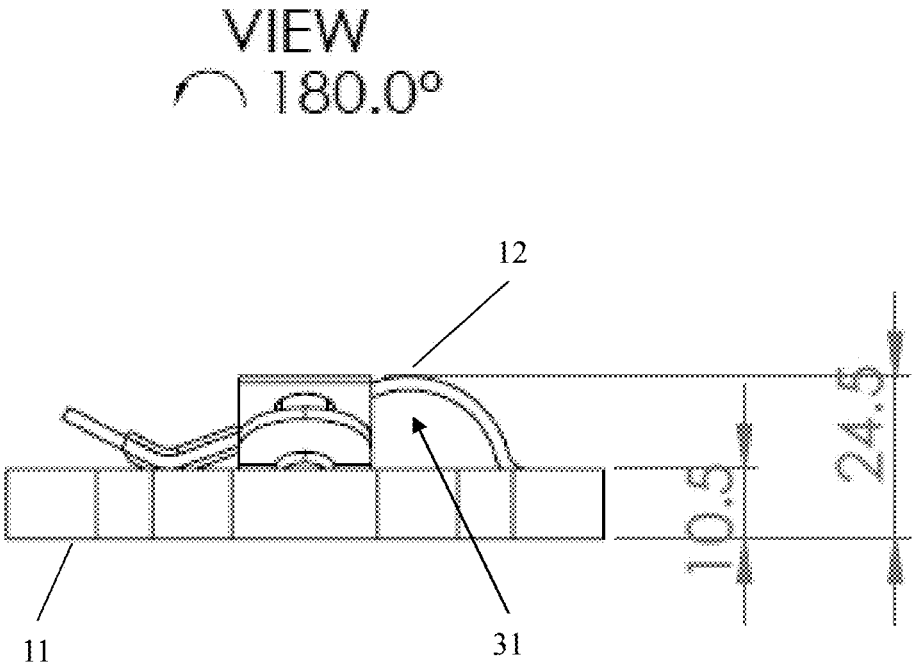
FIG. 8 is a 180.0 degree view of the organizer and hanger taught by the present invention denoting exemplary measurements in millimeters with respect to a hook.

FIG. 7 a side planar view of the organizer and hanger 10 taught by the present invention denoting exemplary measurements in millimeters, and FIG. 8 is a 180.0 degree view of the organizer and hanger 10 taught by the present invention denoting exemplary measurements in millimeters with respect to a protrusion/clip/hook 12.

As shown in FIG. 7, the generally rectangular body 11 is further comprised of three protrusions/clips/hooks 16-18, which are also generally rectangular 19, having rounded external edges 20 and an oval or elongated center hole 21. In this exemplary figure, the top two protrusions/clips/hooks 16-17 are oriented in an upward direction, where the bottom or third protrusion/clip/hook 18 is oriented to a ninety degree left direction. As shown the generally rectangular body 11, in a preferred embodiment, is 360 mm in length and 46.0 mm in width with respect to the opposing tab shaped ends 26-27 which can also have double sided tape 23-24 applied to tab area 22 on each opposing end 26-27 or one or more holes 14-15 on one or both of the opposing end tab areas 22 for engaging a screw or nail.

Figure 9:
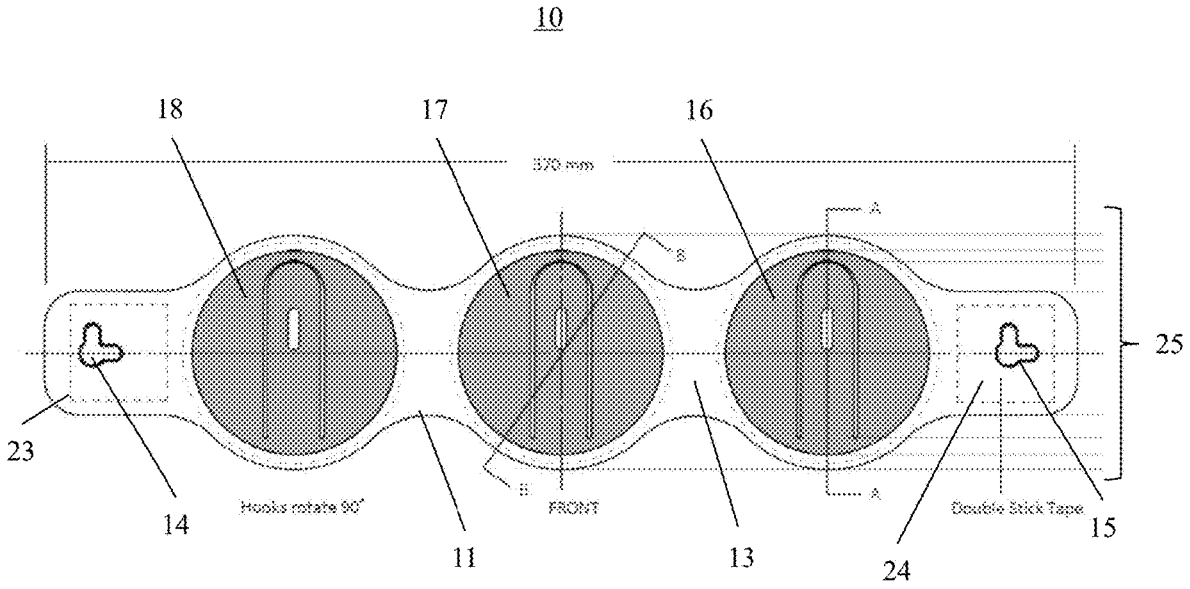
FIG. 9 is a front planar view illustrating double stick tape areas and axis/sections A and B with respect to the rotating hook orientations taught by the organizer and hanger of the present invention.

FIG. 9 is a 180.0 degree view of focusing on the rotating disc 28 of the protrusion/clip/hook 12. As shown in FIG. 8, for a preferred embodiment the rotating disc 28 of the protrusion/clip/hook 12 has a thickness of 10.5 mm and a total height from the base 29 of the rotating disc 28 to the highest point 30 of the "s" shaped protrusion/clip/hook arm 31 of 24.5 mm.

FIG. 9 is a front planar view illustrating double stick tape areas 22 and axis/sections A and B with respect to the rotating protrusions/clips/hooks 16-18 orientations taught by the organizer and hanger 10 of the present invention. As illustrated in FIG. 9, the protrusions/clips/hooks 16-18 can rotate ninety degrees, with sections B and A representing partial axis rotations.

Figure 10:
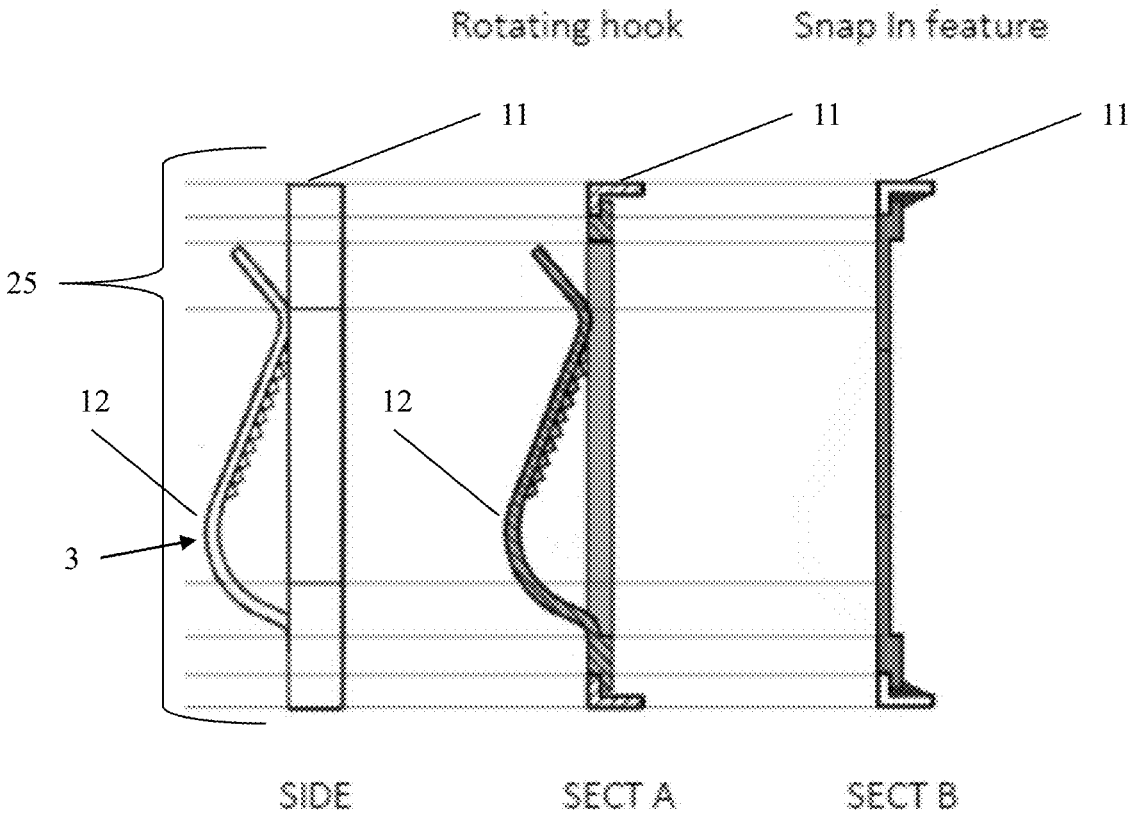
FIG. 10 is a side planar view of one exemplary hook as taught by the present invention with additional section A rotation hook and section B snap in feature illustrations with references lines showing the orientation between the components with respect to FIG. 9.

FIG. 10 is a side planar view of one exemplary protrusion/clip/hook 12 as taught by the present invention with additional section A representing a rotation protrusion/clip/hook 12 assembled to the generally rectangular body 11 and section B illustrating the snap in feature illustrating a rotating disc body 28 of a protrusion/clip/hook 12 assembled to the generally rectangular body 11 with references lines showing the orientation between the components with respect to FIG. 9.

Working left to right in FIG. 10, the first component is the rotating disc 28 of the protrusion/clip/hook 12 and the protrusion/clip/hook 12 from a side planar view. Sect A or section A illustrates the rotating protrusion/clip/hook 12 assembled into the generally rectangular body 11. Sect B or section B illustrates the snap in feature taught by the present invention for connecting the rotating disc 28 of the protrusion/clip/hook 12 and the protrusion/clip/hook 12 to the generally rectangular body 11 and provide rotation and retention into selectable positions.

Figure 12:
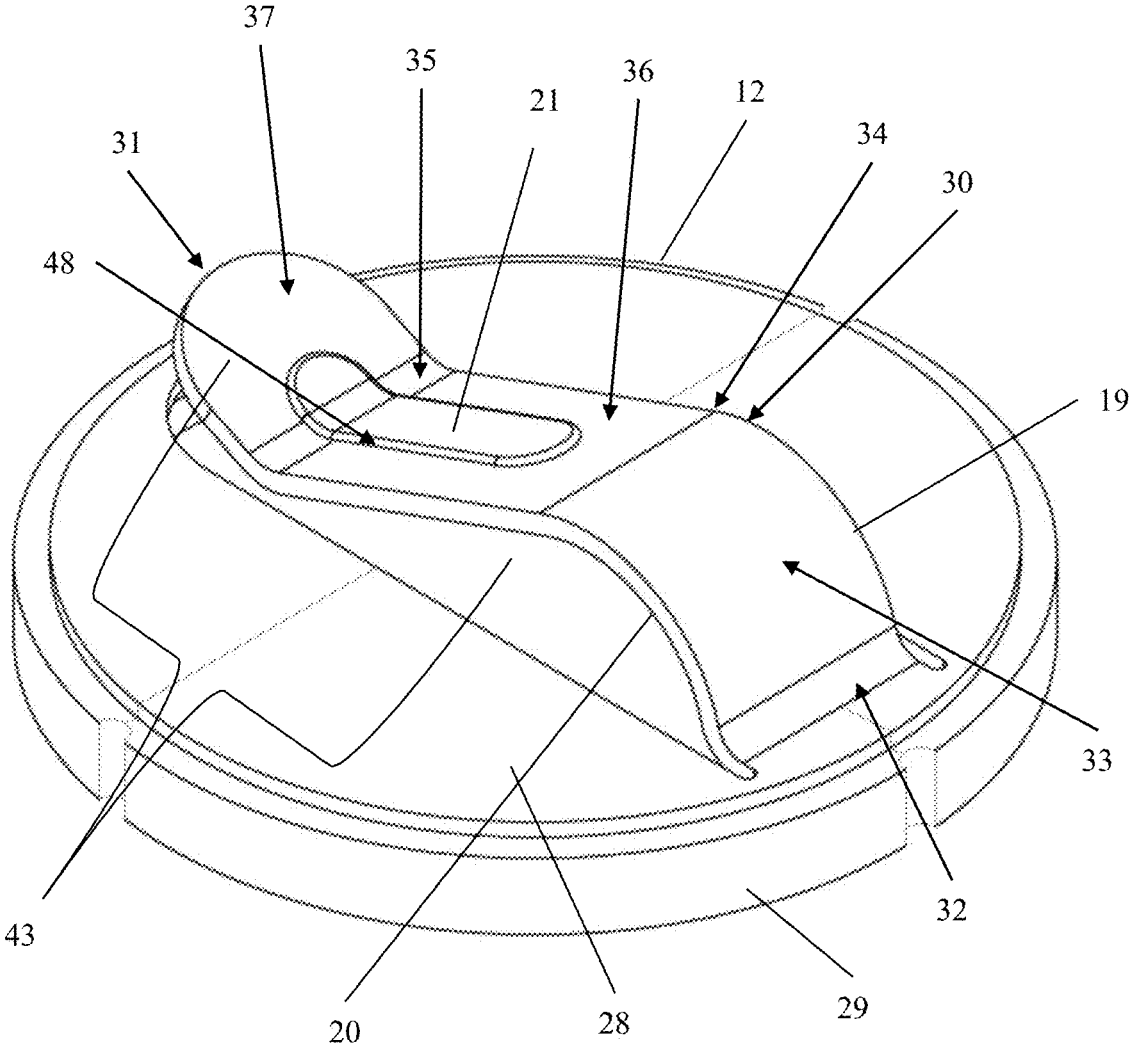
FIG. 12 is a front perspective view of an exemplary hook as taught by the present invention.
Figure 16:
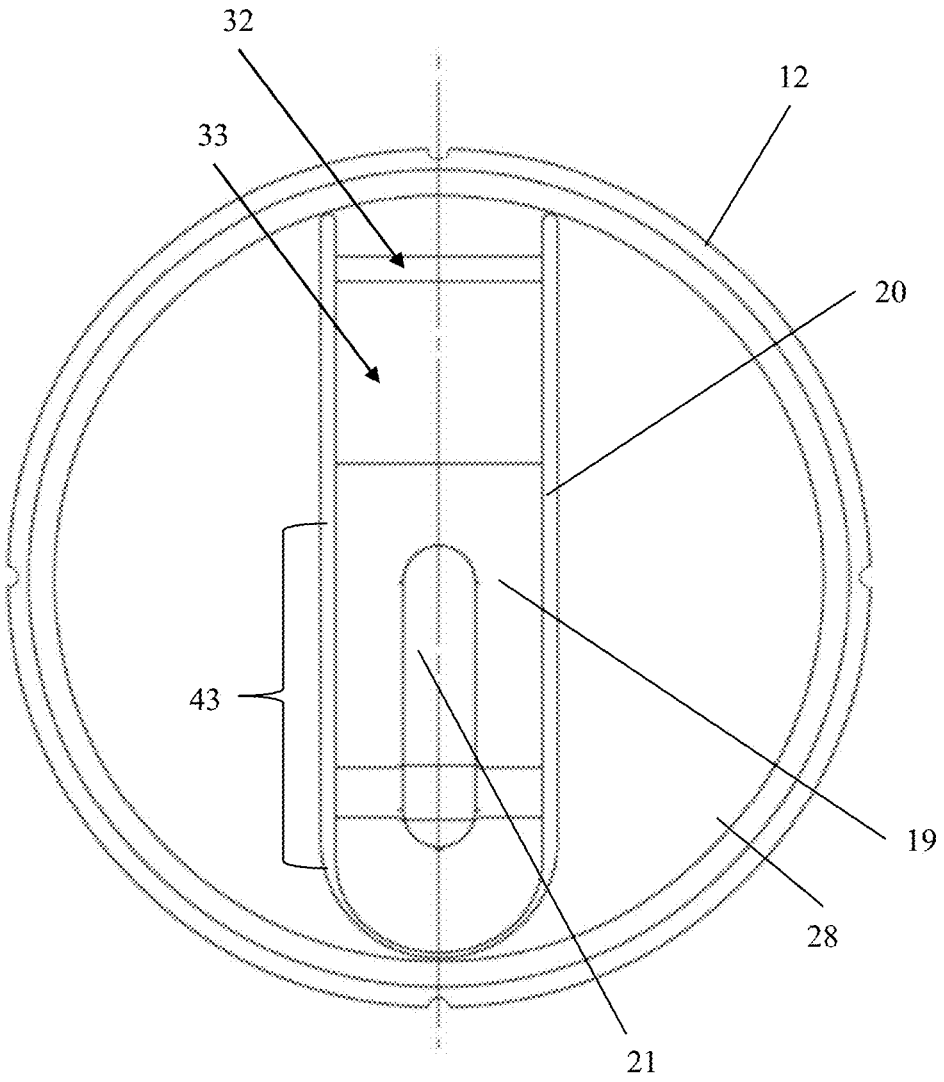
FIG. 16 is a front planar view of an exemplary hook as taught by the present invention including an axis/sectional line for rotational reference in the detailed description discussion.

FIG. 12 is a front perspective view of an exemplary protrusion/clip/hook 12 as taught by the present invention and FIG. 16 is a front planar view of an exemplary protrusion/clip/hook 12 as taught by the present invention including an axis/sectional line for rotational reference in the detailed description discussion. FIGS. 12 and 16 illustrate the rotating disc 28 of the protrusion/clip/hook 12 and the protrusion/clip/hook 12 from a front perspective view.

The protrusions/clips/hooks 16-18 are shown extending from a front side 13 of the rotating disc 28, where the protrusions/clips/hooks 16-18 are generally an "s" shape 31 when viewed from the side or in a perspective view, where the protrusions/clips/hooks 16-18 are attached on one end 32 to the rotating disc 28, where the connected portion 33 extends forward away from the front side 13 of the rotating disc 28, until a first bend 34 which brings the protrusion/clip/hook 12 back toward the front side 13 of the rotating disc 28 for a first given distance, until a second bend 35 which then brings the protrusion/clip/hook 12 away from the front side 13 of the rotating disc 28 for a second given distance, that is generally shorter than the distance 36 between the first bend 34 and second bend 35.

The rotating disc 28 also has four detents for enabling rotations and securing the rotating disc 28 into placed with respect to corresponding protrusions on the inner surface of the holes of the generally rectangular body 11.

Figure 13:
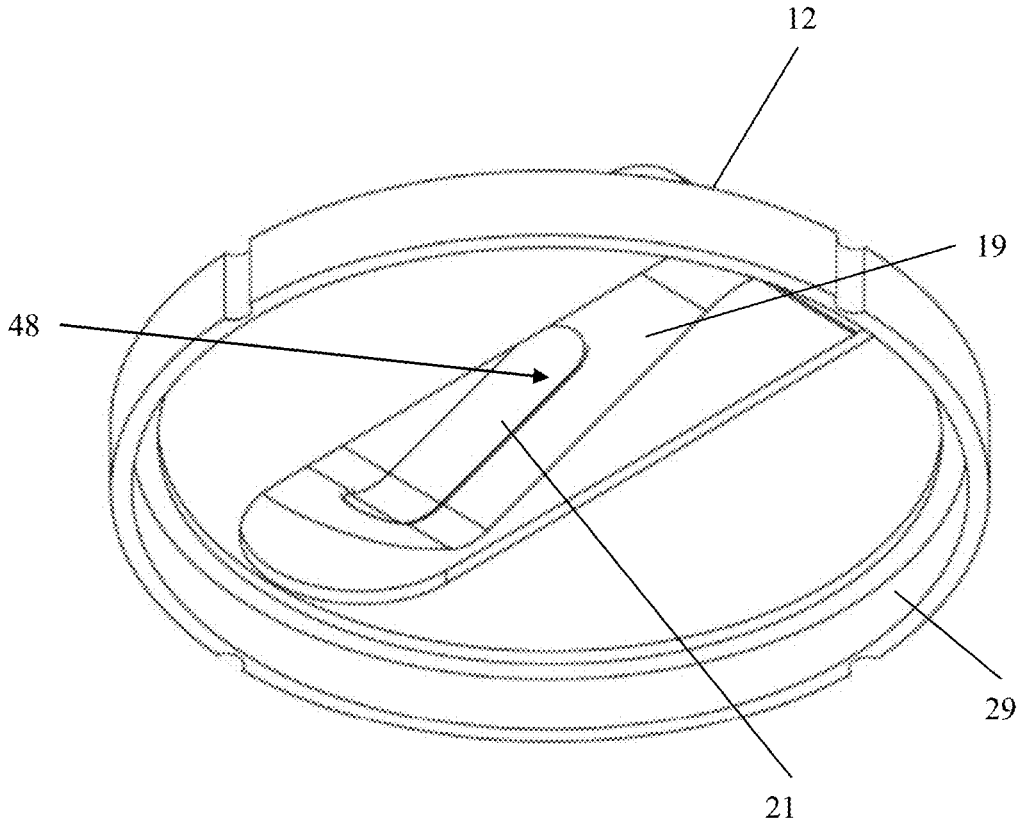
FIG. 13 is a back perspective view of an exemplary hook as taught by the present invention.

FIG. 13 is a back perspective view of an exemplary protrusion/clip/hook 12 as taught by the present invention. The protrusions/clips/hooks 16-18 are shown extending from a front side 13 of the rotating disc 28, where the protrusions/clips/hooks 16-18 are generally an "s" shape 31 when viewed from the side or in a perspective view, where the protrusions/clips/hooks 16-18 are attached on one end 32 to the rotating disc 28, where the connected portion 33 extends forward away from the front side 13 of the rotating disc 28, until a first bend 34 which brings the protrusion/clip/hook 12 back toward the front side 13 of the rotating disc 28 for a first given distance 36, until a second bend 35 which then brings the protrusion/clip/hook 12 away from the front side 13 of the rotating disc 28 for a second given distance 37, that is generally shorter than the distance between the first bend 34 and second bend 35.

Figure 14:
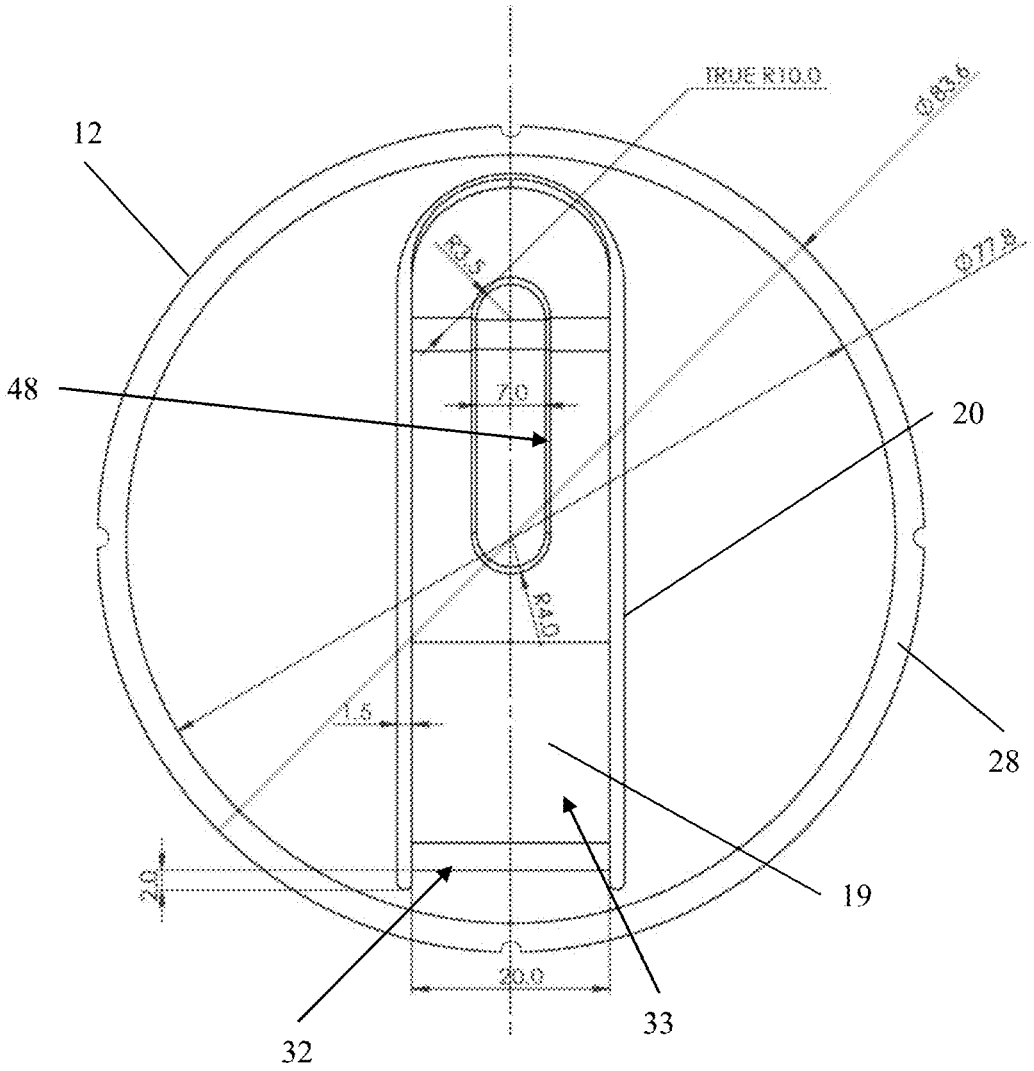
FIG. 14 is a front planar view of an exemplary hook as taught by the present invention including exemplary measurements in millimeters and angles in degrees.
Figure 15:
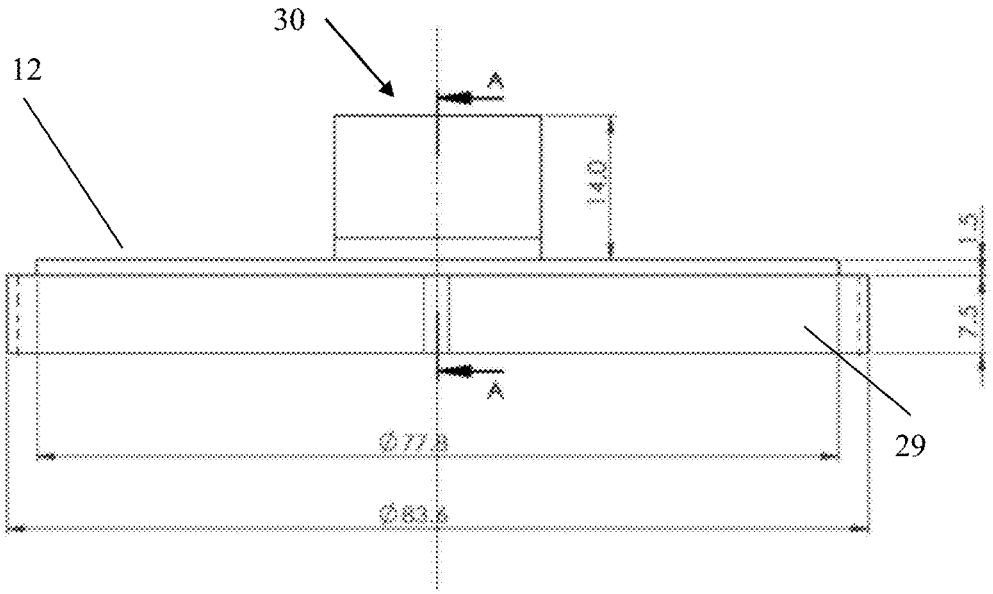
FIG. 15 is a side planar view of an exemplary hook as taught by the present invention including exemplary measurements in millimeters and angles in degrees.

FIG. 14 is a front planar view of an exemplary protrusion/clip/hook 12 as taught by the present invention including exemplary measurements in millimeters and angles in degrees. FIG. 15 is a side planar view of an exemplary protrusion/clip/hook 12 as taught by the present invention including exemplary measurements in millimeters and angles in degrees. FIGS. 14 and 15 illustrate specific sizes for a preferred embodiment of the present invention, but it should be recognized that the optimum dimensional relationships for the parts of the invention, to include variations in size, materials, shape, form, function and manner of operation, assembly, and use, are deemed readily apparent and obvious to one skilled in the art, and all equivalent relationships to those illustrated in the drawings and described in the specification are intended to be encompassed by the present invention.

Figure 17:
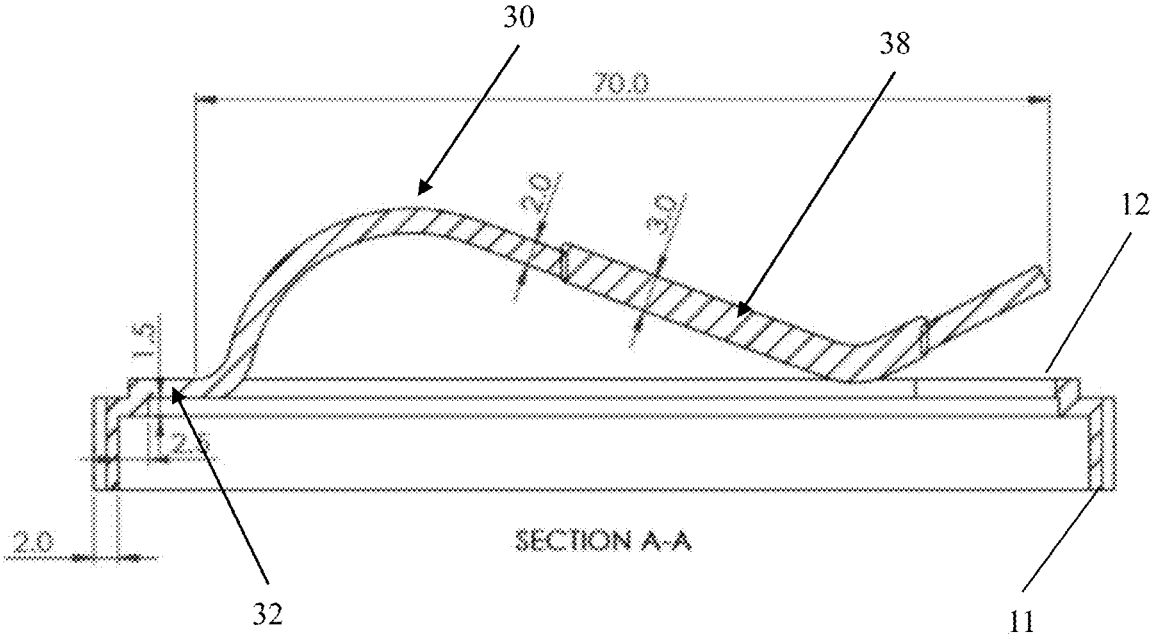
FIG. 17 is a side section A-A view of an exemplary hook as taught by the present invention including exemplary measurements in millimeters and angles in degrees.
Figure 19:
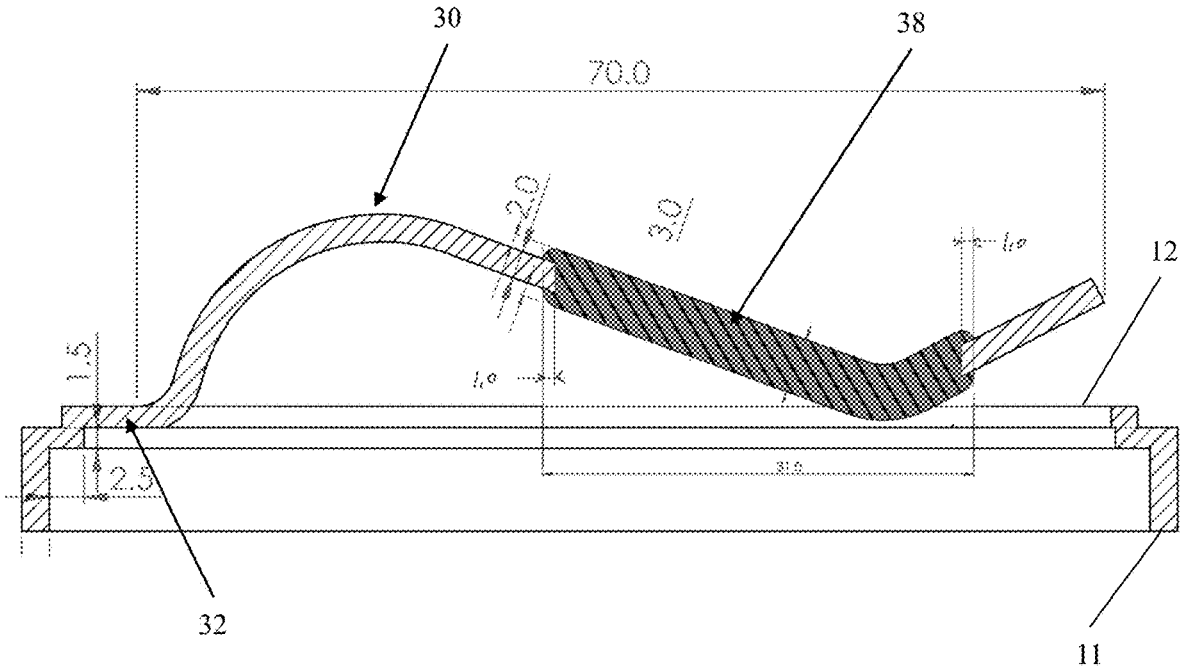
FIG. 19 is a side section A-A view of an exemplary hook as taught by the present invention including exemplary measurements in millimeters, angles in degrees, and illustrating an additional rubberized grip/sleeve on the hook arm.

FIG. 17 is a side section A-A view of an exemplary protrusion/clip/hook 12 as taught by the present invention including exemplary measurements in millimeters and angles in degrees. FIG. 19 is a side section A-A view of an exemplary protrusion/clip/hook 12 as taught by the present invention including exemplary measurements in millimeters, angles in degrees, and illustrating an additional rubberized grip/sleeve 38 on the protrusion/clip/hook arm 39.

In these illustration, the measurements for the specific sections of the s shaped hook 31 are included, as well as the dimensions of the rubber grip/sleeve 38. As shown, in one exemplary embodiment, the protrusions/clips/hooks 16-18 are shown extending from a front side 13 of the rotating disc 28 having a length of approximately 70 mm with a thickness of 1.5 mm at the attachment point 33 of the protrusion/clip/hook 12 to the rotating disc 28, where the protrusion/clip/hook 12 is generally an "s" shape 31 when viewed from the side or in a perspective view having a thickness of 2.0 mm from the transition of attachment 33 to the rotating disc 28 to the open opposing end 40, where the protrusions/clips/hooks 16-17 are attached on one end 33 to the rotating disc 28, where the connected portion 33 extends forward away from the front side 13 of the rotating disc 28, until a first bend 34 which brings the protrusion/clip/hook 12 back toward the front side 13 of the rotating disc 28 for a first given distance 36, until a second bend 35 which then brings the protrusion/clip/hook 12 away from the front side 13 of the rotating disc 28 for a second given distance 37, that is generally shorter than the first given distance 36 between the first bend 34 and second bend 35.

Figure 18:
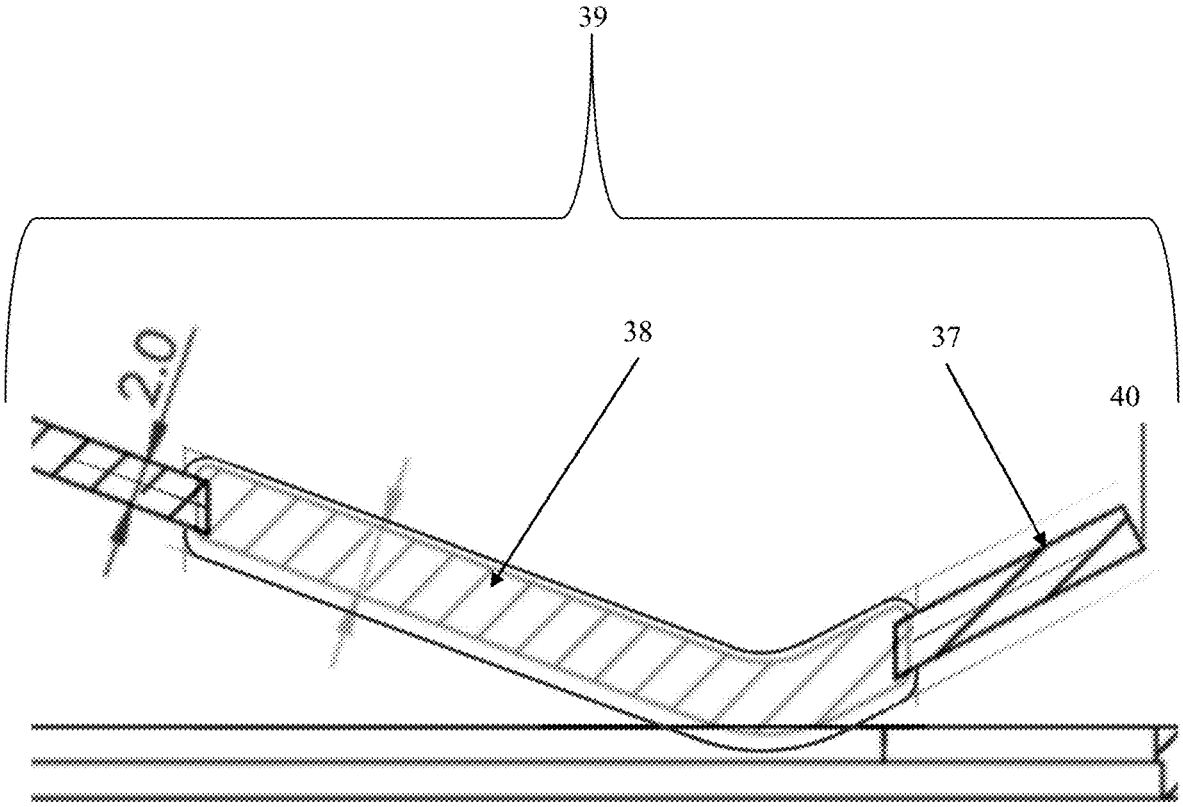
FIG. 18 is a side section A-A view focusing in a close up manner on the end of the hook arm of an exemplary hook as taught by the present invention including exemplary measurements in millimeters and angles in degrees.

As illustrated the thickness of the grip/sleeve 38 is 3.0 mm, or approximately 1.0 mm thick as wrapped around the 2.0 mm protrusion/clip/hook 12 and 31.00 mm in length as more clearly shown by FIGS. 17-19 which is a side section A-A view focusing in a close up manner on the open end of the hook arm 40 of an exemplary protrusion/clip/hook 12 as taught by the present invention including exemplary measurements in millimeters and angles in degrees.

FIGS. 17-19 illustrate the protrusion/clip/hook 12 and rubber sleeve/pad 38 included on the protrusion/clip/hook 12 for providing additional retaining or holding friction. In an alternative embodiment of the present invention as shown in FIGS. 17-19 a small rubber sleeve/pad 38 can be attached to the protrusion/clip/hook portion between the first bend 34 and second bend 35. The rubber sleeve/pad 38 increases the coefficient of friction compared to a metal or plastic embodiment of the present invention without a rubber sleeve/pad 38. This rubber sleeve/pad 38 is critical to providing a better holding force for some objects as well as reducing rattle or noise when used on cabinet doors or other movable surfaces. In the latter situation, the rubber sleeve/pad 38 reduces vibration noise during movement or vibrations experienced by the wall or cabinet door where the present invention might be mounted.

Figure 20:
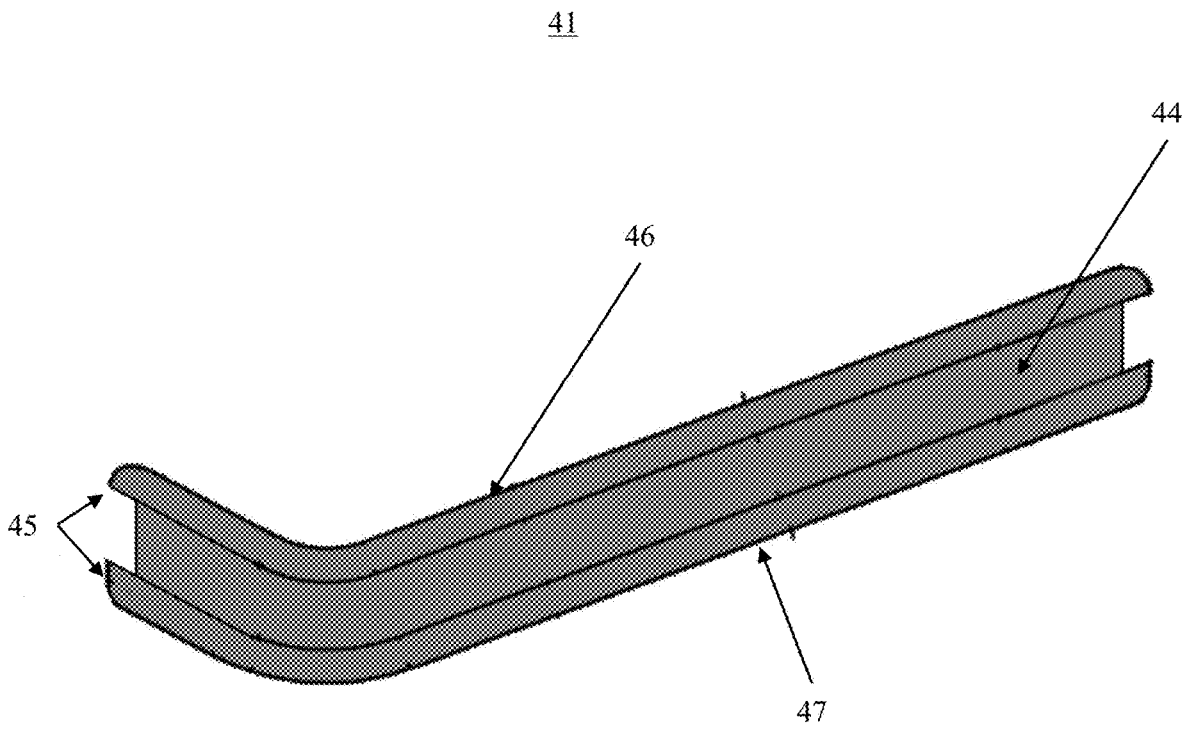
FIG. 20 is a sectional view of a second rubber grip as taught in one exemplary alternative embodiment.
Figure 21:
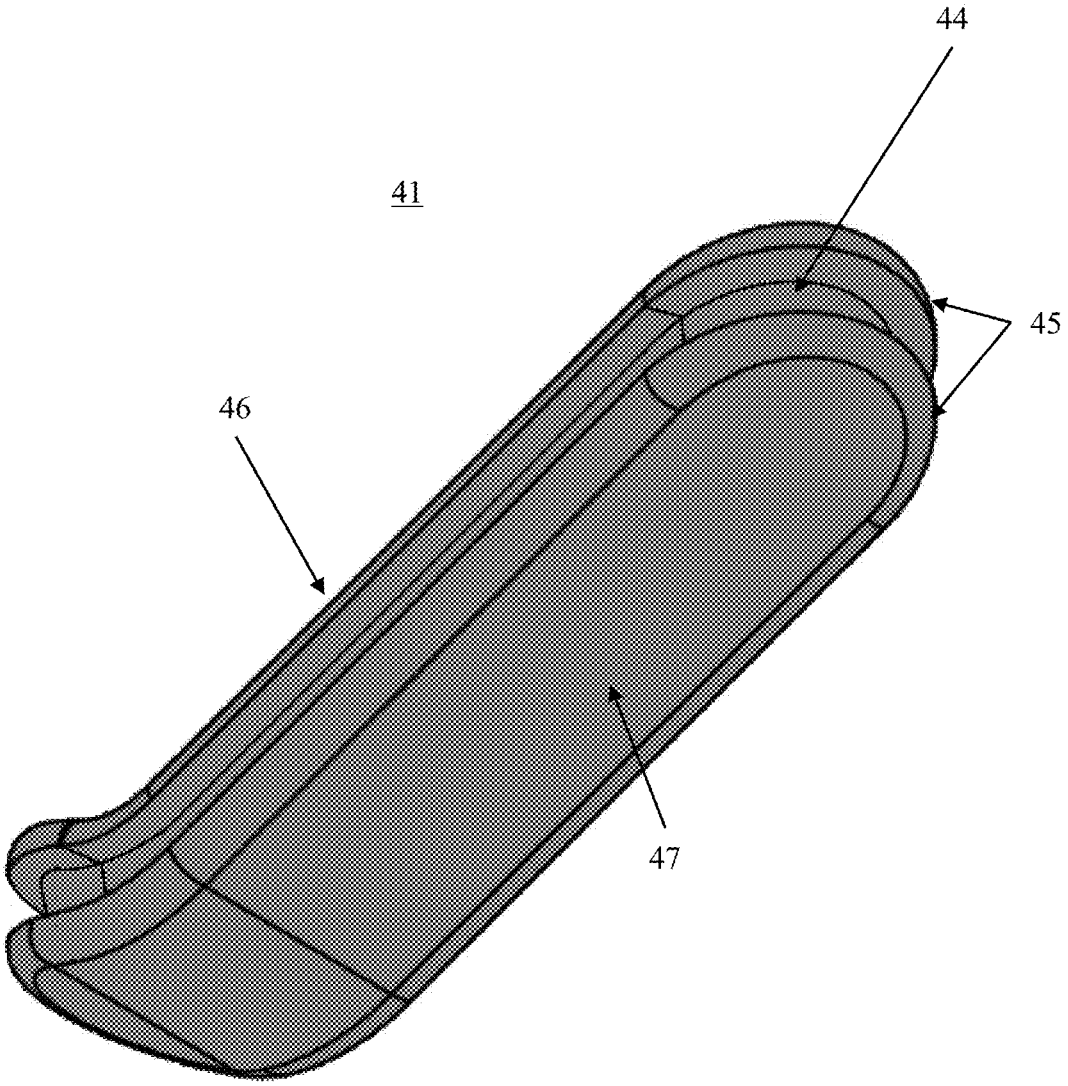
FIG. 21 is a front perspective view of the second rubber grip taught in one exemplary alternative embodiment.
Figure 22:
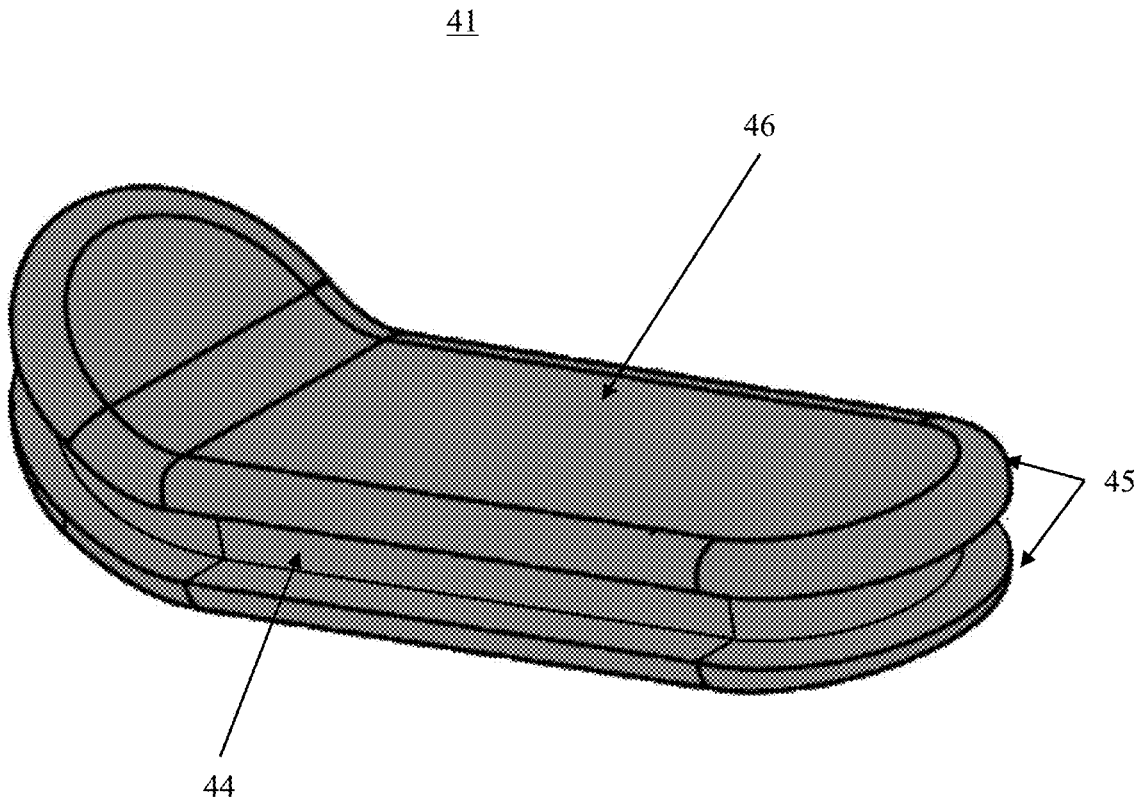
FIG. 22 is a rear perspective view of the second rubber grip as taught in one exemplary alternative embodiment.

FIG. 20 is a sectional view of a second rubber grip as taught in one exemplary alternative embodiment, FIG. 21 is a front perspective view of the second rubber grip taught in one exemplary alternative embodiment, and FIG. 22 is a rear perspective view of the second rubber grip as taught in one exemplary alternative embodiment.

In the alternative embodiment illustrated in FIGS. 20-22 a second, optional rubber grip 41 is illustrated. This second, optional rubber grip 41 is designed to fit into the opening 21 on the protrusion/clip/hook 12. The second, optional rubber grip 41 is shaped in matching contour to the middle section 43 of the s shaped protrusion/clip/hook 12. The second, optional rubber grip 41 is further comprised of a recess 44 running the length of the side surfaces and having a lip 45 on the front surface 46 and back surface 47 for engaging the opening 21 on the protrusion/clip/hook 12. A compression fit with respect to the engagement of the recess 44 on the second, optional rubber grip 41 and the inner surface 48 of the opening 21 on the protrusion/clip/hook 12 retains the second, optional rubber grip 41 in place.

The two versions of the rubber sleeve/pad portion 38 and 41 of the organizer and holder 10 taught by the present invention as shown in FIGS. 17-19 and 20-22 are made from a Thermoplastic rubber (TPR) material. The sleeve/pad 38 may be attached or retained to the protrusion/clip/hook 12 using the oval or elongated holes/openings 21 on the protrusion/clip/hook 12 or it may simply be formed to compression fit around the protrusion/clip/hook 12 surface and opposing sides to hold it into place.

Figure 23:
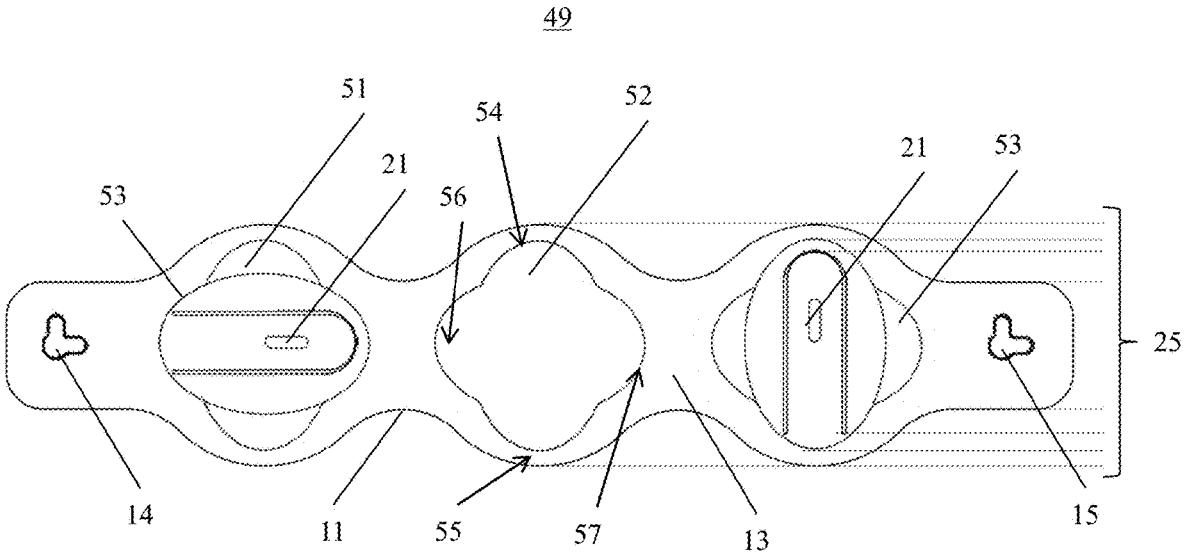
FIG. 23 is a front planar view of an alternative embodiment of the present invention illustrating an alternative oval shaped rotating hook embodiment.
Figure 24:
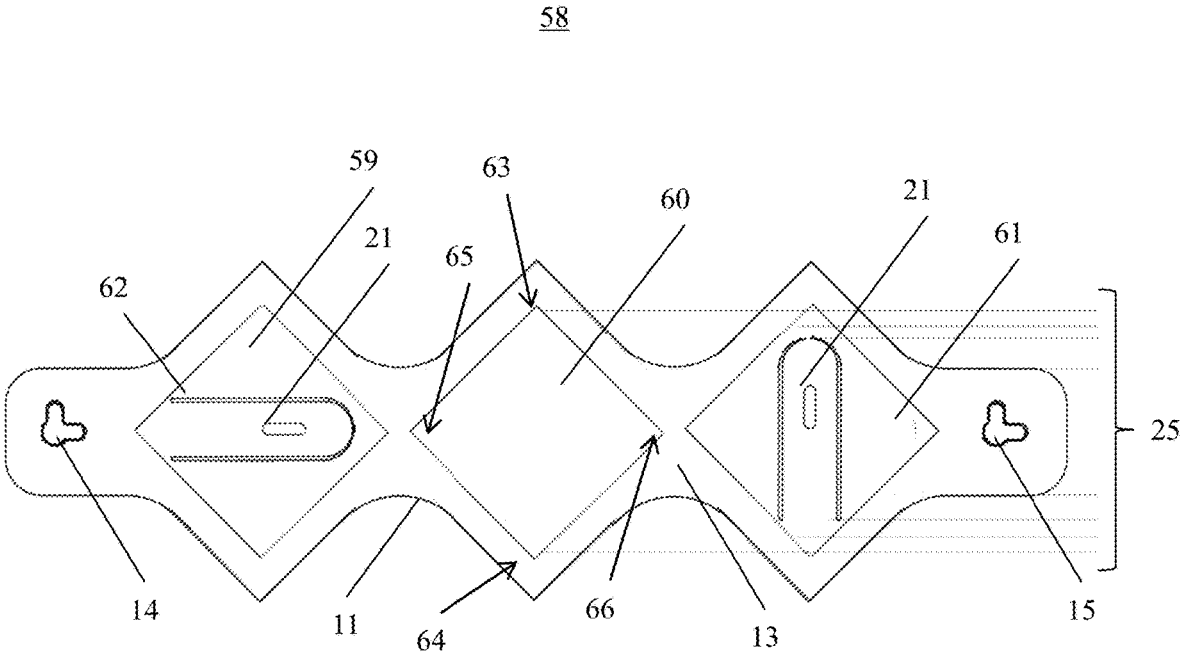
FIG. 24 is a front planar view of an alternative embodiment of the present invention illustrating an alternative square/diamond shaped rotating hook embodiment.

FIGS. 23-24 illustrate two alternate shapes teaching alternative embodiments usitlity shapes other than round protrusion/clip/hook parts/discs which can be rotated to at least two positions. In these exemplary illustrations, these two alternative embodiments are merely shown as 900 to one another. One could also rotate some shapes by 60° etc. like hexagons or even the ellipse shown here in FIG. 23 by making the recess shape accept it. Other shapes may necessitate it to be removed or partially removed and reattached/snapped in etc. to secure. Round is preferred for its ability to stay secured but rotate. Detents and locks may/may not be needed but the description includes both variations while the inventors continue with research and experimentation of which variations is best for the market and intended uses.

FIG. 23 is a front planar view of an alternative embodiment of the present invention illustrating an alternative oval shaped rotating hook embodiment 49. This is alternative embodiment where the generally rectangular shaped body 11 is comprised of three double oval shaped openings 50, 51, and 52 for engaging a single oval shaped rotating disc 53. In this alternative embodiment, the single oval shaped rotating disc 53 can be placed into four distinct positions 54, 55, 56, and 57 with respect to the double oval shaped opening 50, 51, and 52 on the generally rectangular body 11. The four positions 54, 55, 56, and 57 place the oval shaped rotating disc 53 and protrusion/clip/hook into four defined positions 54, 55, 56, and 57, those being up 54, down 55, left 56, and right 57, where each defined position 54, 55, 56, and 57 is ninety degrees from the two adjacent positions, and each of the four positions 54, 55, 56, and 57 is ninety degrees apart.

FIG. 24 is a front planar view of an alternative embodiment of the present invention illustrating an alternative square/diamond shaped rotating hook embodiment 58. This is alternative embodiment where the generally square or diamond shaped body 58 is comprised of three square or diamond shaped openings 59, 60, and 61 for engaging a single square or diamond shaped rotating disc 62. In this alternative embodiment, the single square or diamond shaped rotating disc 62 can be placed into four distinct positions 63, 64, 65, and 66 with respect to the square or diamond oval shaped openings 59, 60, and 61 on the generally rectangular body 11. The four positions 63, 64, 65, and 66 place the rotating disc 62 and protrusion/clip/hook into four defined positions 63, 64, 65, and 66, those being up 63, down 64, left 65, and right 66, where each position is ninety degrees from the two adjacent positions, and each of the four positions 63, 64, 65, and 66 is ninety degrees apart.

In one embodiment, the present invention may be injection molded from a suitable plastic. In another embodiment, the present invention can be made from a suitable metal material using a stamping, pressing, and/or punching process or a combination there of.

In all embodiments, the rubber sleeve/pad 38 and/or second, optional rubber grip 41 would be comprised of a thermoplastic rubber (TPR), which is a semi-crystalline material with both rubber-like and thermoplastic properties. This means it is flexible and can be manufactured using melt processing techniques like injection molding. TPR material is synthesized using block copolymers like SBS (Styrene-Butadiene-Styrene). TPR provides the characteristics desired by the present invention and was selected after rigorous testing.

A typical installation of the present invention is where adhesive strips or doubled sided tape 23-24 are used to attach the organizer and hanger 10 to a wall or cabinet door in one embodiment of the present invention, where adhesive strips or doubled sided tape 23-24 are applied to the wall or cabinet door first.

In another embodiment, the organizer and hanger 10 is installed by first peeling away the covering from adhesive strips or doubled sided tape 23-24 and placing them either on the wall or cabinet door, and then positioning the organizer and hanger 10 over the adhesive strips or doubled sided tape 23-24 and holding for a period of time, typically 20 seconds to secure the adhesive strip or doubled sided tape 23-24 to both the organizer and hanger 10 and the wall or cabinet door.

Although the present invention has been described in considerable detail with reference to certain preferred versions thereof, other versions are possible. Therefore, the point and scope of the appended claims should not be limited to the description of the preferred versions contained herein.

As to a further discussion of the manner of usage and operation of the present invention, the same should be apparent from the above description. Accordingly, no further discussion relating to the manner of usage and operation will be provided.

With respect to the above description, it is to be realized that the optimum dimensional relationships for the parts of the invention, to include variations in size, materials, shape, form, function and manner of operation, assembly, and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

Thus, it is appreciated that the optimum dimensional relationships for the parts of the invention, to include variation in size, materials, shape, form, function, and manner of operation, assembly, and use, are deemed readily apparent and obvious to one of ordinary skill in the art, and all equivalent relationships to those illustrated in the drawings and described in the above description are intended to be encompassed by the present invention.

Furthermore, other areas of art may benefit from this method and adjustments to the design are anticipated. Thus, the scope of the invention should be determined by the appended claims and their legal equivalents, rather than by the examples given.

The embodiments of the invention in which an exclusive property or privilege is claimed are defined as follows:

1. An organizer and hanger, comprising:

a generally rectangular body; and a plurality of protrusions, clips, and hooks or a combination thereof extending from a front surface for securing or hanging objects, a rubber sleeve/pad included on the protrusion/clip/hook for providing additional retaining or holding friction;

the rubber sleeve/pad is attached to the protrusion/clip/hook portion between the first and second bends;

the plurality of protrusions, clips, and hooks or a combination thereof extend from a front side of a rotating disc having a length of 70 mm with a thickness of 1.5 mm at an attachment point of the protrusion/clip/hook to the rotating disc, where the protrusion/clip/hook is generally an "s" shape when viewed from the side or in a perspective view having a thickness of 2.0 mm from the transition of attachment to the rotating disc to an open opposing end;

the plurality of protrusions, clips, and hooks or a combination thereof are attached on one end to the rotating disc, where a connected portion extends forward away from the front side of the rotating disc, until a first bend which brings the protrusion/clip/hook back toward the front side of the rotating disc for a first given distance, until a second bend which then brings the protrusion/clip/hook away from the front side of the rotating disc for a second given distance, that is generally shorter than the first given distance between the first bend and second bend; and a sleeve/pad is formed to compression fit around the protrusion/clip/hook surface and opposing sides to hold it into place.

2. The organizer and hanger of claim 1, wherein the grip/sleeve is 3.0 mm or 1.0 mm thick as wrapped around the 2.0 mm protrusion/clip/hook and 31.00 mm in length.

3. The organizer and hanger of claim 1, wherein the protrusion/clip/hook and rubber sleeve/pad are included on the protrusion/clip/hook for providing additional retaining or holding friction;

the small rubber sleeve/pad is attached to the protrusion/clip/hook portion between the first bend and second bend; and the rubber sleeve/pad increases the coefficient of friction compared to a metal or plastic embodiment of the present invention without a rubber sleeve/pad.

4. An organizer and hanger, comprising:

a generally rectangular body;

a plurality of protrusions, clips, and hooks or a combination thereof extending from a front surface for securing or hanging objects;

a rubber grip designed to fit into an opening on the protrusion/clip/hook;

the rubber grip is shaped in matching contour to a middle section of an s shaped protrusion/clip/hook;

the rubber grip is further comprised of a recess running a length of the side surfaces and having a lip on the front surface and back surface for engaging the opening on the protrusion/clip/hook; and a compression fit with respect to the engagement of the recess on the rubber grip and the inner surface of the opening on the protrusion/clip/hook retains the rubber grip in place.

* * * * *